US005731746A

United States Patent [19]

Sokola et al.

[11] Patent Number: 5,731,746

[45] Date of Patent: Mar. 24, 1998

[54] MULTI-FREQUENCY CERAMIC BLOCK FILTER WITH RESONATORS IN DIFFERENT PLANES

[75] Inventors: Raymond L. Sokola; Mark H. Ballance, both of Albuquerque; Michael A. Newell, Placitas; David R. Heine, Albuquerque, all of N. Mex.; Keith R. Manssen, Long Grove, Ill.

[73] Assignee: Motorola Inc., Schaumburg, Ill.

[21] Appl. No.: 497,192

[22] Filed: Jun. 30, 1995

[51] Int. Cl.[6] ..... H01P 1/213; H01P 1/205

[52] U.S. Cl. ..... 333/134; 333/202; 333/206

[58] Field of Search ..... 333/202, 203, 333/206, 222, 134, 202 DB

[56] References Cited

U.S. PATENT DOCUMENTS 4,546,333 10/1985 Fukasawa et al. ..... 333/203 X
5,012,210 4/1991 Marconi et al. ..... 333/203 X
5,210,916 5/1993 Zakman ..... 333/134 X
5,568,101 10/1996 Konishi et al. ..... 333/206 X

FOREIGN PATENT DOCUMENTS 5335807 12/1993 Japan ..... 333/206

*Primary Examiner*—Benny Lee
*Attorney, Agent, or Firm*—Gary J. Cunningham; Colin M. Raufer

[57] ABSTRACT

A ceramic filter (100) is disclosed. The filter (100) has a filter body comprising a dielectric material having a plurality of surfaces with each surface having a plurality of metallized through holes extending through the dielectric material defining a first series of resonators (102) in a first plane and a plurality of second metallized through holes in a different plane and extending transversely with relation to the first, defining a second series of resonators (104). The filter (100) also has a metallization layer substantially coating all surfaces of the filter (100) with the exception that a portion of the surface surrounding each resonator is left unmetallized, and a coupling structure (108) for coupling electrical signals into and out of filter (100).

13 Claims, 3 Drawing Sheets

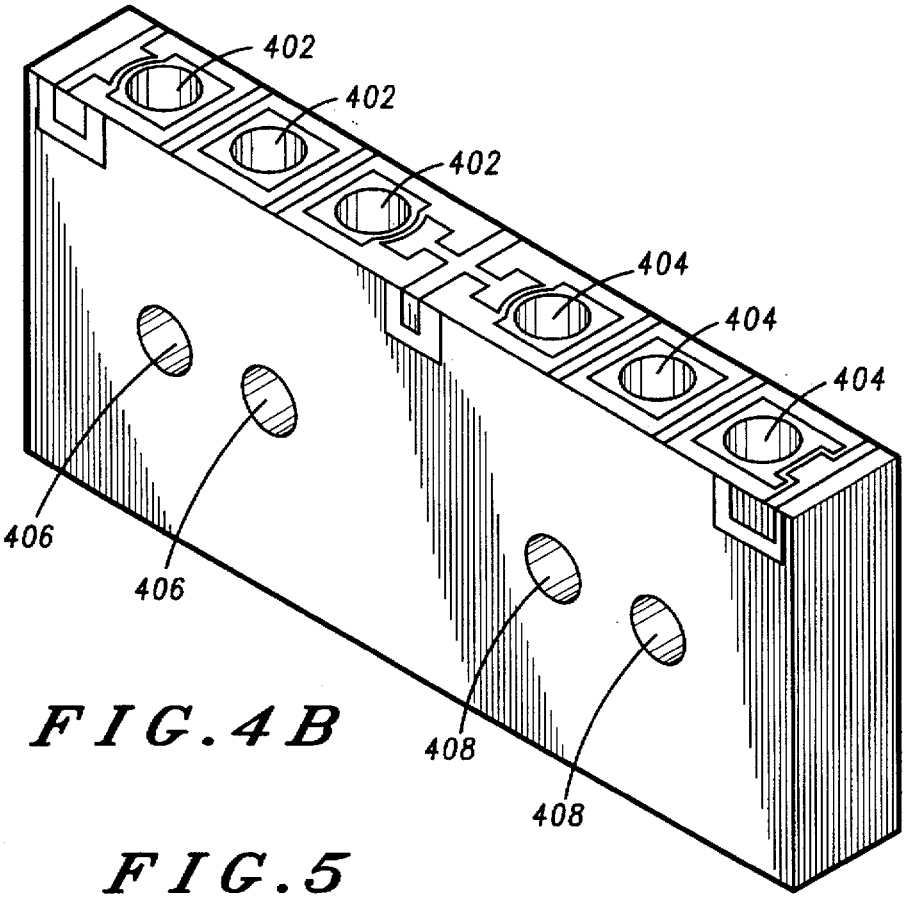
FIG.4B
FIG.5
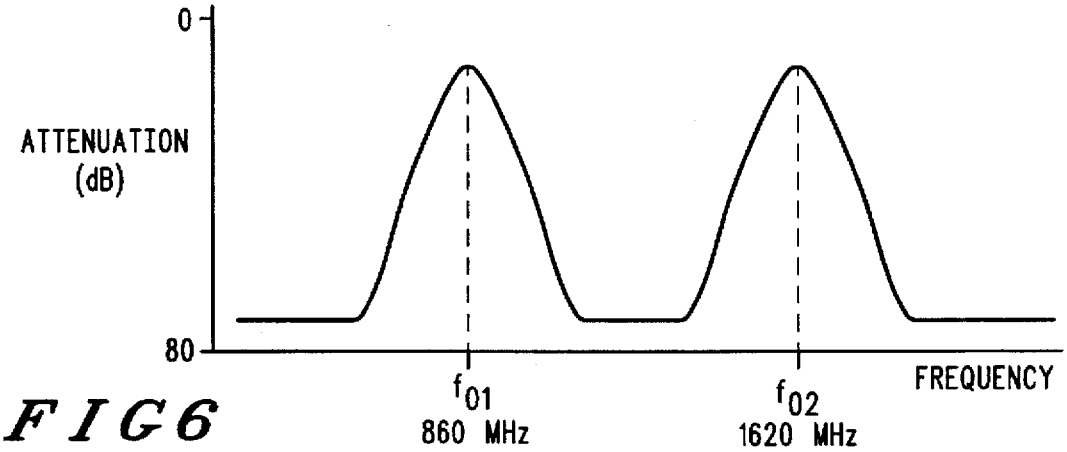
FIG6
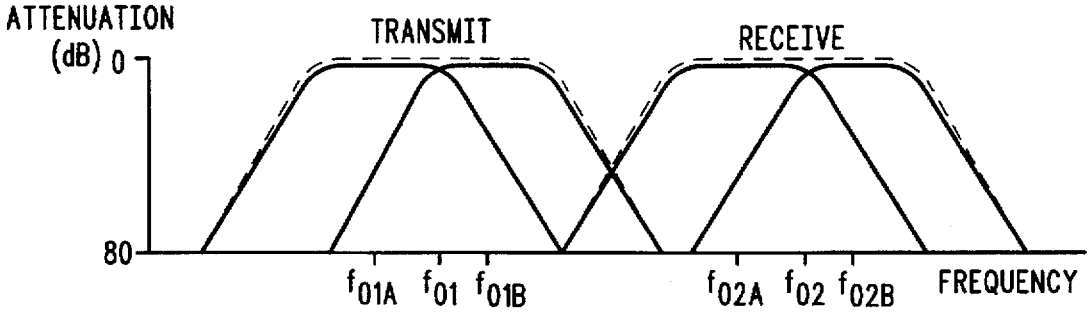

MULTI-FREQUENCY CERAMIC BLOCK FILTER WITH RESONATORS IN DIFFERENT PLANES

FIELD OF THE INVENTION

This invention relates to electrical filters, and more particularly, to ceramic block filters with resonators in different planes.

BACKGROUND OF THE INVENTION

The use of dielectric block filters to remove undesirable electrical frequencies from an electrical signal is well known in the art.

Ceramic block filters have found wide acceptance for use in radio communications devices, particularly high frequency devices such as pagers, cellular telephones, and other telecommunications devices.

The blocks are relatively easy to manufacture, rugged, have improved performance characteristics over discrete lumped circuit elements, and are relatively compact.

Although various improvements have been made in the design of ceramic filters, many designs still incorporate metallized through holes to form resonators. The trend toward miniaturization of components which have lower losses and smaller sizes has been occurring gradually over the past several years.

Another trend in the industry involves the use of higher frequencies at higher bands in the electromagnetic spectrum for wireless telecommunications equipment. Whereas prior art filters were required to perform in the UHF field, some next generation wireless telecommunications equipment will operate at much higher microwave frequencies.

The ability of any single communication device to retain its viability and utility will directly depend upon its capacity to communicate with other mediums of communication.

As a result, ceramic block filters must not only continue to reduce their size, cost and weight, but they must also evolve to simultaneously filter multiple bands in the electromagnetic spectrum.

A dielectric ceramic block which could filter two or more different pass-band frequencies in a single block while also reducing size by making a more efficient use of block space, would be considered an improvement over the prior art.

BRIEF DESCRIPTION OF THE DRAWINGS

FIGS. 4A and 4B show front and rear views respectively of a multi-frequency ceramic block dual duplexer filter, in accordance with the present invention.

FIG. 5 shows a graph of a frequency response curve when four series of resonators, 402, 404, 406, and 408 respectively, are coupled to the same input-output pads in accordance with the present invention.

FIG. 6 shows a typical frequency response curve for a Personal Communication Services (PCS) band, in accordance with the present invention.

DETAILED DESCRIPTION OF THE PREFERRED EMBODIMENT

Figure 1:
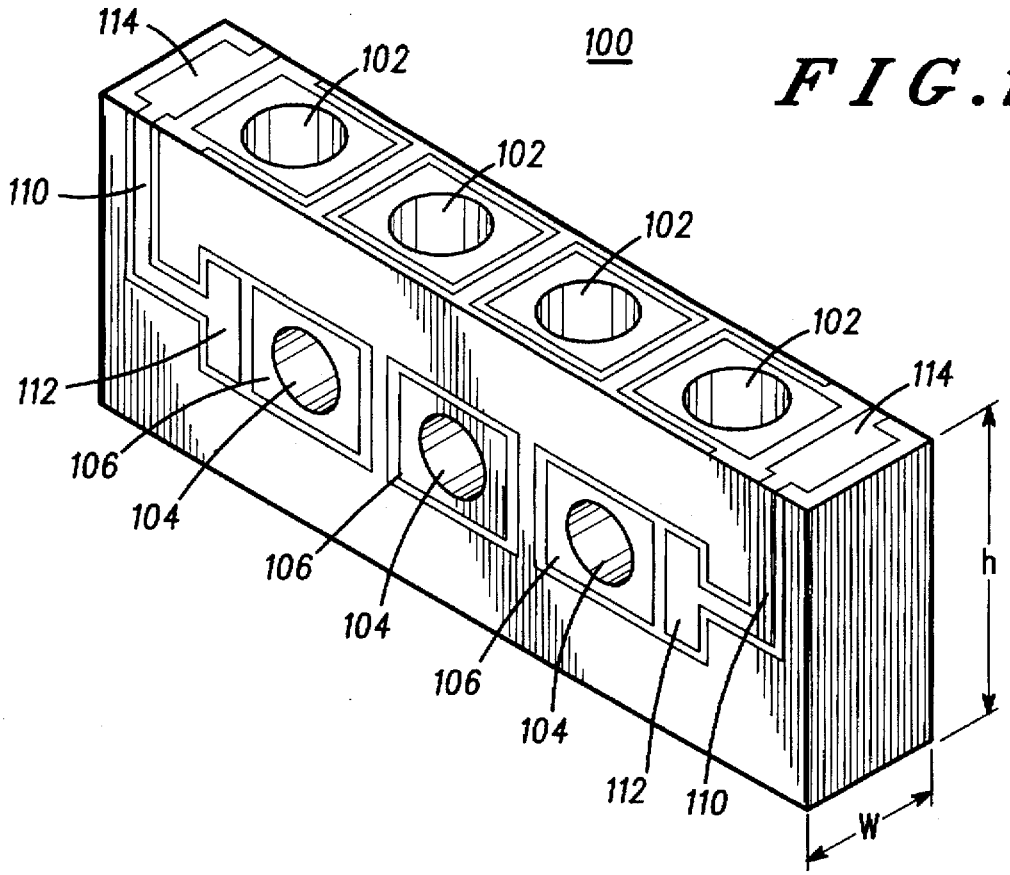
FIG. 1 shows a perspective view of a multi-frequency ceramic block filter achieved by placing resonators in different planes, in accordance with the present invention.

FIG. 1 shows a preferred embodiment of a multi-frequency ceramic block filter 100. The filter 100 has the ability to pass two distinct frequency bands due to the fact that there are resonators in two different planes of the filter block.

Figure 2:
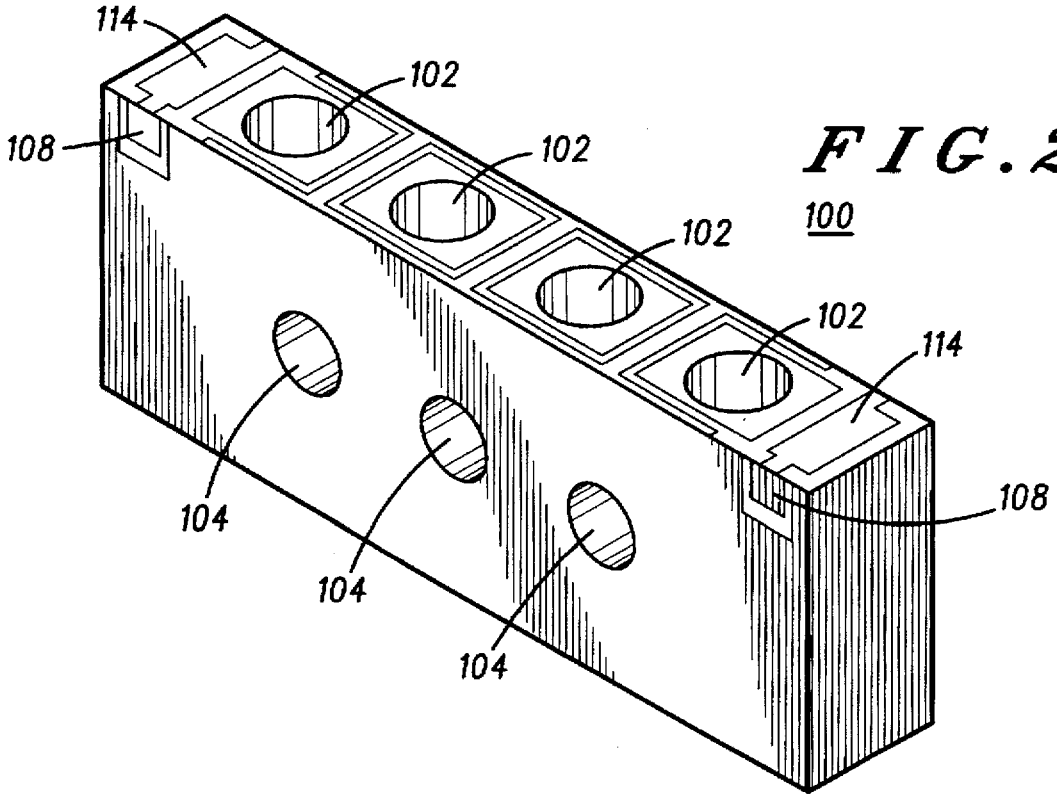
FIG. 2 shows a rear perspective view of the multi-frequency ceramic block filter of FIG. 1, in accordance with the present invention.

The relationship between the two passed frequency bands will depend upon the dimensions of the block itself. The ratios of the center frequencies will be approximately inversely proportional to the ratio of the length of the resonators, which will depend upon the dimensions of the block. As shown in FIGS. 1 and 2, a first series of vertical resonators 102 are located between the top and bottom surfaces of the block. They are generally slightly less than one-quarter wavelength at the center frequency of interest. A second set of horizontal resonators 104 are shown located between the front and rear surfaces of the dielectric block. Likewise, they are also slightly less than one-quarter wavelength at the desired center frequency of interest. Consequently, once the desired frequencies are known, the corresponding height and width parameter can be determined. More particularly, once the frequency of the filters are known, the block dimensions can then be set.

The aspect ratio, defined as the width to height ratio (w/h in FIG. 1), of most conventional ceramic block filters tends to be rather large. This is due to the fact that filters are often designed to have very small height dimensions to accommodate the miniaturization requirements of many electronic products. The present invention actually exploits this characteristic of ceramic block filters by passing two very distinct and separate frequency bands.

In FIG. 1, the dielectric block is shown substantially coated on all surfaces with a metallization layer with the exception that a portion of the surface 106 surrounding each resonator is unmetallized. The metallization layer may be applied using conventional screen printing and spraying processes.

An important feature in this design involves the relationship of the input-output pads to the various resonator planes. In the simplest case, if each series of resonators has its own corresponding set of input-output pads, then the result will merely be two separate and distinct filters which share the same dielectric block.

On the other hand, if both sets of resonators are coupled to the same set of input-output pads, then the result will be a single filter with two distinct passbands. An exemplary graph of a typical frequency response curve for this situation is shown in FIG. 5. FIG. 5 shows the graph of attenuation in decibels (dB) versus frequency. There are two distinct passbands centered at (fo1) and (fo2) respectively. The filter 100 of FIGS. 1 and 2, as detailed above has two distinctive passbands, such as at about (cellular phone frequency) 860 MHz and (Iridium frequency) 1620 MHz, and offers distinct design advantages. A single ceramic filter which can be used for multiple frequencies offers the advantages of conserving size and weight while at the same time providing the feature of multi-frequency filtering capabilities which is desirable in the electronics industry.

Referring to FIG. 2, a perspective view of the opposite (rear) side of the multi-frequency ceramic block filter 100 of FIG. 1 is shown. When FIGS. 1 and 2 are viewed together, the vertical series of resonators 102 are capacitively coupled to the input-output pads 108 (see FIG. 2) and the horizontal series of resonators 104 are capacitively coupled to a first pair of coupling members 112 (see FIG. 1). The first pair of coupling members 112 are attached to conductive transmission lines which run to the top surface of the block filter (100). On the top surface block 100, as shown in FIGS. 1 and 2, the transmission lines 110 attach to a second pair of coupling members 114. The second pair of coupling members 114 traverse the top surface of the block, provide additional capacitive coupling to the end resonators in the vertical plane, and connect to the input/output pads 108 which are located on the opposite surface of the filter, adjacent to the top surface of the block. Thus, items 110, 112, 114 and 108 define a wraparound input-output pad structure, to facilitate surface mounting. As shown in FIGS. 1 and 2, the first series of resonators 102 and the second series of resonators 104, each pass through the dielectric monolithic-block of ceramic 100. Thus, the drawings illustrate that the individual resonators in each series 102 and 104, do not intersect inside the monolithic-block of dielectric ceramic 100.

Figure 3:
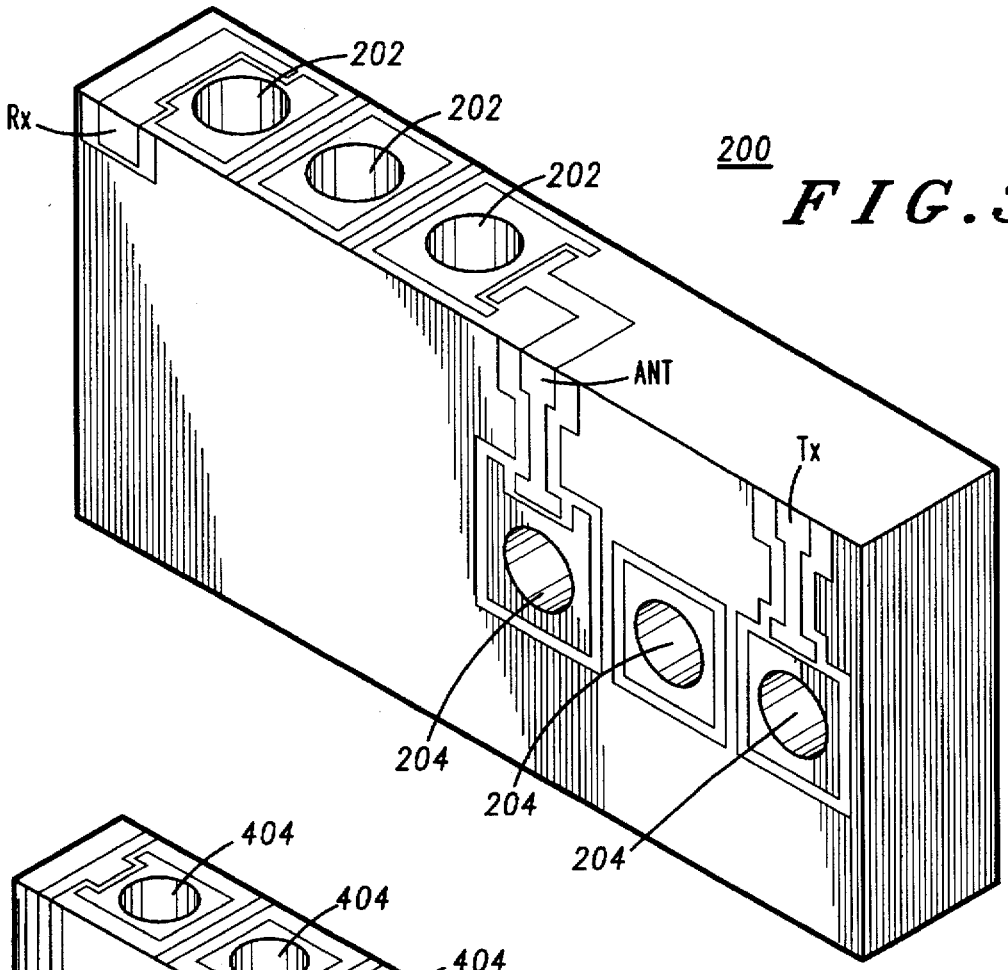
FIG. 3 shows an alternate multi-frequency ceramic block duplex filter with resonators in different planes located at each end of the block, in accordance with the present invention.

Referring to FIG. 3, an alternate duplex filter 200 is shown. In this case, the dielectric block has three input-output pads, in which the first pad serves as an input for a Transmit (Tx) signal, the second pad serves as both an output pad for the Transmit (Tx) signal and an input pad for a Receive (Rx) signal, also called an Antenna pad (ANT) and a third pad serves as an output pad for a Receiving (Rx) signal as is illustrated in FIG. 3.

In FIG. 3, the duplex filter 200 has a first series of resonators in a horizontal plane and a second series of resonators in a vertical plane. In this embodiment, the two series of resonators are located at different ends of the block, as shown in FIG. 3. More particularly, at one end (distal end) of the block the resonators 202 are in the vertical plane, and at the other end (proximal end) of the block the resonators 204 are in the horizontal plane. Once again, two separate and distinct filters are incorporated into one dielectric block to minimize space, weight and required componentry. In FIG. 3, (although not shown) bottom and rear surfaces are metallized and the through holes adjacent to such surfaces define short circuited ends. The other end of the through-holes (resonators) are defined as the open-circuited ends.

Figure 4A:
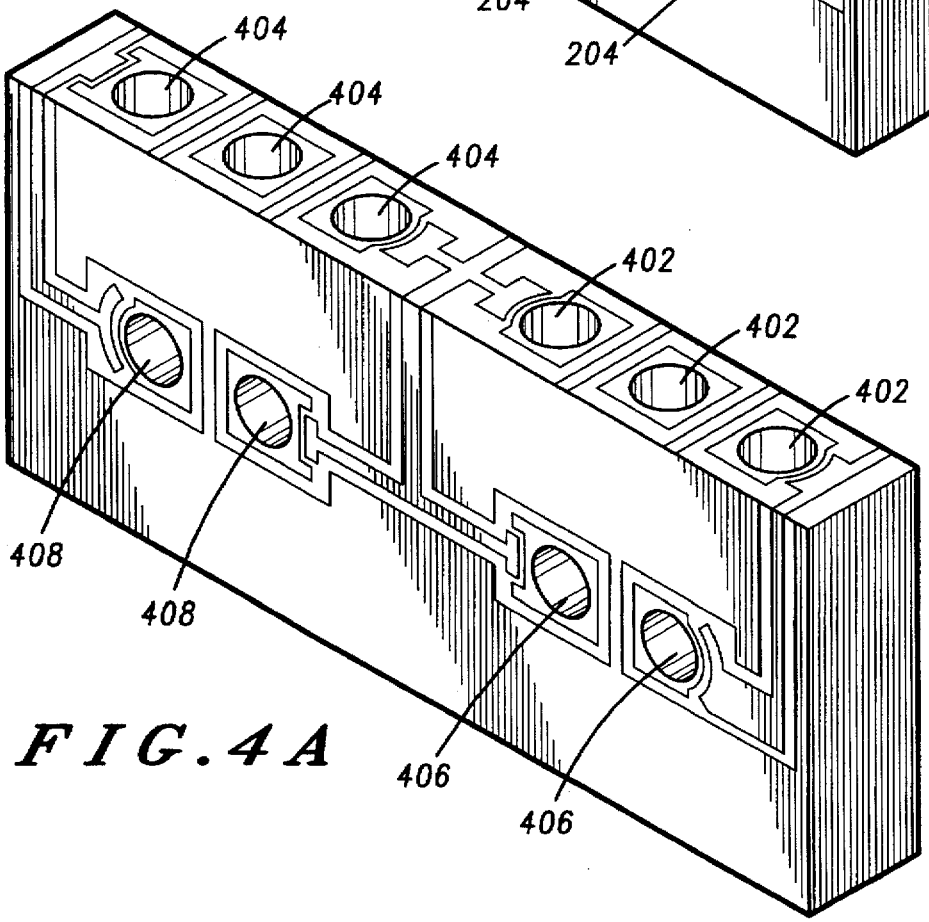

In another embodiment, a dual duplexer is disclosed. In FIGS. 4A and 4B, resonators 402 and 404 form a pair of filters in the vertical plane. These filters combine to form a 3-part duplexer centered at a desired frequency (F1). The ceramic block becomes a dual duplexer when additional resonators 406 and 408 form a pair of filters in the horizontal plane. These filters combine to form a 2-part dual duplexer centered at a desired frequency (F2). Both duplexers share the same three input/output ports. In the dual duplexer design, two separate duplex filters can both be incorporated into the same dielectric ceramic block. As should be understood by those skilled in the art, various modifications can be made. Any filter which has resonators in different planes in the same dielectric block is considered within the scope of the present invention, as detailed herein.

Under current filter design, the coupling of the resonators can be controlled by non-symmetrical placement of the resonator holes. For example, by moving the location of the resonator holes closer to the input-output pads, capacitive coupling is increased. This would continue to be true with the present invention. However, due to the fact that resonators will be on sides of the block with larger surface areas, the designer has more freedom to control coupling by strategic placement of the resonators.

From the above, it is clear that the resonators are not required to be centered on the surface of the block. In fact, movement of the resonator through holes to adjust the coupling between the resonators is a design parameter. Also, the present invention contemplates various resonator geometries. For example, one embodiment may use circularly shaped resonators whereas other embodiments may use elliptically shaped resonators. By adjusting the shape and spacing of the resonator through holes, many different filters can be designed. These parameters can also be used to adjust intercell coupling (K) and resonator impedance (Zo).

The present invention also allows a designer to take advantage of many different techniques for coupling the resonators to the input-output pads. For example, capacitively coupling through the dielectric, edge capacitance techniques, and the use of conductive transmission lines to facilitate capacitive coupling at another location on the block are just a few of the coupling techniques contemplated by the present invention. The coupling technique can become a major design consideration as the complexity of the multi-frequency block increases. Consequently, it may become necessary to employ different coupling techniques within the same dielectric block as dictated by design considerations. For example, a first series of resonators may be capacitively coupled to their respective input-output pads, whereas a second series of resonators may use conductive transmission lines in order to couple to the same input-output pads.

In one embodiment, the present invention can include a filter with resonator sets in three or more different planes. For example, a triplex filter could be designed which has the capability of filtering three frequency bands. One set of resonators could filter a receive signal, another set of resonators could filter a transmit signal, and a third set of resonators could be used as a clean up filter, a local oscillator injection filter or the like. Thus, various front end filters in a cellular radio design can be integrated into a single dielectric block, thereby reducing the number of components while also reducing both size and weight.

In another embodiment, a transmit filter and a corresponding clean up filter can be incorporated into the same dielectric block. Since both filters would be operating at the same frequency, the result would be a dielectric block which has a cross-section which is essentially square in shape.

As the number of resonator sets is increased, the dielectric medium may evolve from a block form to other more elaborate shapes, for example, triangular or hexagonal in shape.

The present invention is particularly applicable for use in the Personal Communication Services (PCS) frequency bands and other wide passband filters. The fact that both PCS frequency bands are about 60 MHz wide with narrow guard bands can lead to difficulty in the design of duplex filters. However, by segmenting the PCS band (1850 MHz to 1910 MmHz) into two blocks (namely an upper block of 1880 MHz to 1910 MHz and a lower block of 1850 MHz to 1880 MHz), and by further aligning each set of resonators with a corresponding frequency, greater selectivity can be achieved.

FIG. 5 shows a frequency response curve for the filter of FIGS. 4A and 4B when four series of resonators are coupled to a single set of input and output connections. FIG. 5 shows Attenuation (measured in dB) along the vertical axis having exemplary values between 0–80 dB. Also in FIG. 5, Frequency (in MHz) is measured along the horizontal axis. Center frequency (fo1), in this case shown at 860 MHz, is a composite of the response curves of resonator series 402 and resonator series 404 respectively. Center frequency (fo2), in this case shown at 1620 MHz, is a composite of the response curves of resonator series 406 and 408 respectively.

FIG. 6 shows a typical frequency response curve for the PCS bands in accordance with the present invention. In FIG. 6, the dotted line shows typically wide passbands with gently sloping frequency response curves achieved by conventional filter technology. In contrast, the two solid lines in each band (Tx & Rx) can be combined to attenuate the same signals. This is achieved by splitting each passband into two distinct segments and filtering each segment separately. This can be accomplished by placing a series of resonators in different planes of a ceramic block filter, as detailed herein. By splitting the band into two segments and aligning one series of resonators for each frequency, a wide passband with a sharply sloped response curve can be achieved. Thus, in one application, the present invention provides a means of filtering the PCS frequency band (which is achieved by placing resonators in different planes of a single dielectric ceramic block), with sharply sloped response curves.

The procedure for splitting the passband as shown in FIG. 6, can be best described with an example. For the Tx signal, filter F01A may be centered at 1865 MHz. Another filter in the same block (F01B) can be centered at 1895 MHz. Together, F01A and F01B creates a Tx signal called F01 centered at 1880 MHz which has a desired profile with more sharply sloped sides than previous filter designs (as shown in dashed lines). The same principle can be used for the Rx signal which operates at a higher frequency. For the Rx signal, filter F02A may be centered at 1945 MHz. Another filter in the same block (F02B) may be centered at 1975 MHz. Together, F02A and F02B create an Rx signal called F02 centered at 1960 MHz which has a desired profile with sharply sloped sides (as shown as dashed line). The embodiment shown in FIGS. 4A and 4B can be used to accomplish the desired frequency response (in dashed line), in FIG. 6.

The present invention is not limited, however, to intraband filtering. For example, a filter can be designed which is used for a split band application such that the first series of resonators filter out a frequency in one band of the electromagnetic spectrum and the second series of resonators filter out a frequency in another band of the electromagnetic spectrum. More specifically, a filter can be designed for a split band application in which the first series of resonators filter out a frequency in the 900 mHz range and the second series of resonators filter a signal in the 2 GHz range of the electromagnetic spectrum.

The method of fabrication for the present invention will undoubtedly be different from present conventional pressing technology. Incorporating through holes in different planes may require the use of various pins in different axes of the block. Although prototypes can be produced by conventional machining processes, the present invention contemplates large volume production using advanced pressing technology.

Although various embodiments of this invention have been shown and described, it should be understood that various modifications and substitutions, as well as rearrangements and combinations of the preceding embodiments can be made by those skilled in the art, without departing from the novel spirit and scope of this invention.

What is claimed is:

1. A ceramic filter, comprising:

a substantially parallelepiped-shaped ceramic filter body having substantially metallized through holes and comprising a monolithic-block of dielectric material having a top, bottom, and four side surfaces, the through holes including a first series of metallized through holes extending from the top to the bottom surface, thereby defining a first series of resonators providing a first filter, and a second series of metallized through holes extending from one of the side surfaces to an opposite one of the side surfaces, thereby defining a second series of resonators, providing a second filter, the first filter having a first passband and the second filter having a second passband, a metallization layer substantially coating the surfaces of the filter body with the exception that a portion of the surfaces immediately surrounding an electrically open circuit end of each resonator is unmetallized, and first and second input-output pads comprising an area of conductive material on one of the side surfaces and being substantially surrounded by an uncoated area for coupling a signal into and out of the filter body.

2. The filter of claim 1, wherein said dielectric monolithic-block has three input-output pads such that the first input-output pad defines an input for a transmit signal, the second input-output pad defines both an output for a transmit signal and an input for a receiving signal, and a third input-output pad defines an output pad for the receiving signal, the first series of resonators passes the transmit signal and the second series of resonators passes the receiving signal, thereby defining a duplexer.

3. The filter of claim 2, wherein said dielectric monolithic-block further includes a third series of resonators extending from the top to the bottom surface substantially parallel to the first series of resonators to pass a second transmit signal and a fourth series of resonators extending from one of the side surfaces to an opposite one of the side surfaces and substantially parallel to the second series of resonators to pass a second receiving signal, the first, second, third, and fourth series of resonators define a dual duplexer.

4. The filter of claim 1, wherein the first series of resonators filter a frequency in one band of the electromagnetic spectrum and the second series of resonators filter a frequency in another band of the electromagnetic spectrum.

5. A ceramic filter, comprising:

a substantially parallelepiped-shaped ceramic filter body having metallized through holes, comprising a monolithic-block of dielectric material having a top, bottom, front, rear, first end and second end surfaces, the through holes including a first series of metallized through holes extending from the top to the bottom surfaces, thereby defining a first series of resonators providing a first filter, a second series of through holes extending from the front surface to the back surface, the second series of through holes being substantially perpendicular to the first series of through holes and the second series of through holes positioned substantially between the resonators of the first series of resonators and not intersecting the first series of resonators and extending substantially transversely with relation to the first series of resonators, thereby defining a second series of resonators resonating at a different frequency than the first series of resonators, the second series of resonators providing a second filter, the first filter and the second filter provide a multi-frequency device, a metallization layer substantially coating all surfaces of the filter body with the exception that a portion of the surface immediately surrounding an electrically open circuit end of each resonator is unmetallized, and an input and an output on the rear surface of the monolithic-block of dielectric material.

6. The filter of claim 5, wherein the first series of resonators and the second series of resonators are capacitively coupled to the input and the output.

7. The filter of claim 5, wherein the first series of resonators are coupled to the input and output by a coupling structure which is distinct from a coupling structure used to couple the second series of resonators to the input and output.

8. The filter of claim 5, wherein both the first series of resonators and the second series of resonators are capacitively coupled to the input and output with a wraparound coupling structure, including:

a first pair of coupling members which are adjacent to the first series of resonators in a horizontal plane;

a second pair of coupling members which traverse the top surface of the monolithic-block adjacent to the second series of resonators in a vertical plane; and a conductive transmission line between the first pair of coupling members and the second pair of coupling members.

9. The filter of claim 5, wherein the first series of resonators pass a predetermined range of frequencies with minimal attenuation in approximately the 900 MHz range and the second series of resonators pass a predetermined range of frequencies with minimal attenuation in approximately the 2 GHz range.

10. The filter of claim 5, wherein the first series of resonators and the second series of resonators filter different frequencies in a Personal Communication Services frequency band.

11. The filter of claim 5, wherein the first series of resonators are located substantially adjacent to the first end surface in a substantially vertical direction extending from the top to the bottom surface of the monolithic-block and the second series of resonators are located substantially adjacent to the second end surface in a substantially horizontal direction extending from the front surface to the rear surface of the monolithic-block, the first and the second series of resonators being substantially perpendicular to each other.

12. The filter of claim 5, wherein the first series of resonators filter a signal to a broad range of frequencies and the second series of resonators more narrowly filter the same signal to a specific predetermined frequency.

13. The filter of claim 5, wherein multiple series of resonators respectively filter multiple frequencies substantially within the dielectric monolithic-block.

* * * * *